United States Patent [19]

Komori et al.

[11] 3,948,586

[45] Apr. 6, 1976

[54] JAM DETECTING DEVICE IN A COPYING MACHINE

[75] Inventors: Shigehiro Komori; Hisashi Sakamaki, both of Yokohama; Hiroyuki Hattori, Mitaka; Toshihide Iida, Tokyo; Koichi Miyamoto, Tokyo; Kazumi Umezawa, Yokohama, all of Japan

[73] Assignee: Canon Kabushiki Kaisha, Tokyo, Japan

[22] Filed: Apr. 4, 1974

[21] Appl. No.: 457,891

Related U.S. Application Data

[63] Continuation of Ser. No. 303,000, Nov. 2, 1972.

[52] U.S. Cl. ..... 355/14; 355/3 R

[51] Int. Cl.[2] ..... G03G 15/22

[58] Field of Search..... 355/3, 14, 3 DR; 271/57, 271/230

[56] References Cited

UNITED STATES PATENTS

| | | | |
|---|---|---|---|
| 3,495,822 | 2/1970 | Cederbaum | 355/14 X |
| 3,588,472 | 6/1971 | Glaster et al. | 355/14 X |
| 3,693,969 | 9/1972 | Sakamaki | 355/14 X |
| 3,734,604 | 5/1973 | Szostak | 355/14 |
| 3,804,512 | 4/1974 | Komori et al. | 355/11 X |

*Primary Examiner*—L. T. Hix
*Assistant Examiner*—Kenneth C. Hutchison
*Attorney, Agent, or Firm*—Fitzpatrick, Cella, Harper & Scinto

[57] ABSTRACT

In a copying machine, a jam detecting device comprises jam detecting means operable in synchronism with movement of the photosensitive drum of the copying machine, and copy sheet discharge detecting means provided at an outlet for copy sheet. The two detecting means are positioned relative to each other so that T1 ≦ T2, where T1 is the time interval required for a copy sheet fed from its supply station to reach an outlet and T2 is the time interval measured from the time the copy sheet leaves the supply station till the jam detecting means is operated for a second time. When T1 is greater than T2, jamming of the copy sheet is detected.

4 Claims, 3 Drawing Figures

JAM DETECTING DEVICE IN A COPYING MACHINE

This is a continuation of application Ser. No. 303,000 filed Nov. 2, 1972.

BACKGROUND OF THE INVENTION

1. Field of the Invention

This invention relates to a device for detecting jamming of copying sheets in a copying machine.

2. Description of the Prior Art

In high speed copying machines of the type wherein an electro-static latent image is formed on a photosensitive medium and the image is developed and transferred to copy sheets, a heat source of great capacity is required to fix the transferred images. If any copy sheet jams within the fixing means having such a heat source incorporated therein, dangerous smoke or fire will occur. It is therefore necessary to quickly detect any copy sheet jamming and stop the machine, deenergize the heater or operate an alarm mechanism.

SUMMARY OF THE INVENTION

The present invention is directed to a device for detecting such jamming, and intends to improve the accuracy of the detection by the use of a simple arrangement without any malfunctioning resulting from a variation in source voltage.

In accordance with the present invention, closing of a main switch energizes a motor which operates a photosensitive medium, copy sheet conveyor means and so on to make the machine ready for copying operation.

Once in place, an original to be copied may be moved in synchronism with the photosensitive medium. In a predetermined time relationship therewith, a copy sheet may be fed from a supply station to a transfer station. The design is such that the copy sheet reaches the outlet before the jam detecting means which is operable synchronously with the movement of the photosensitive medium is operated for a second time. In other words, the design is such that the point in time at which a first copy sheet reaches the outlet is a little earlier than the point in time at which the jam detecting means is operated for a second copy sheet (this latter point in time is referred to as "a second operating period"). Whenever there is any copy sheet jammed in the machine, the two points in time are reversed in their relation. Therefore, if such condition takes place, the jam detecting means will operate to cause an alarm signal to be generated, cause the machine to be stopped or cause the heat source to be electrically disconnected.

BRIEF DESCRIPTION OF THE DRAWINGS

The invention will become fully apparent from the following detailed description thereof taken in conjunction with the accompanying drawings, in which.

DESCRIPTION OF THE PREFERRED EMBODIMENTS

Figure 1:
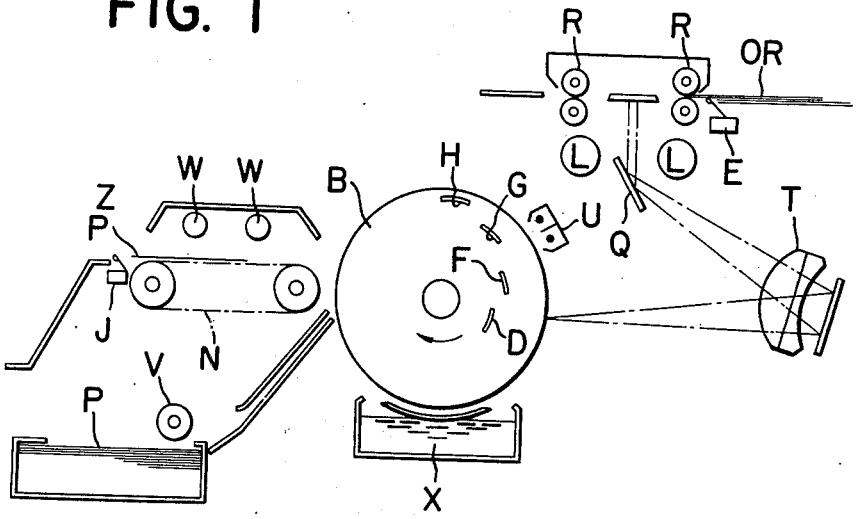
FIG. 1 is a schematic illustration of a copying machine provided with the jam detecting device according to an embodiment of the present invention.
Figure 2:
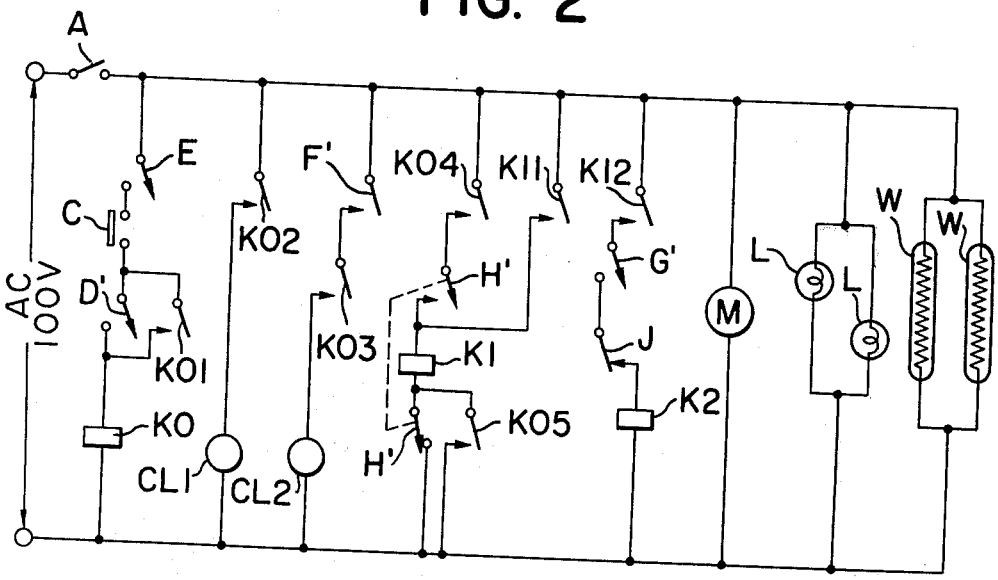
FIG. 2 is a diagram showing the control circuit of such device.

An embodiment as shown in the drawings will now be described in detail. Closing a main switch A operates a motor M, which in turn rotates a photosensitive drum B, a conveyor belt N for copy paper P and a paper feed roller V.

Figure 3:
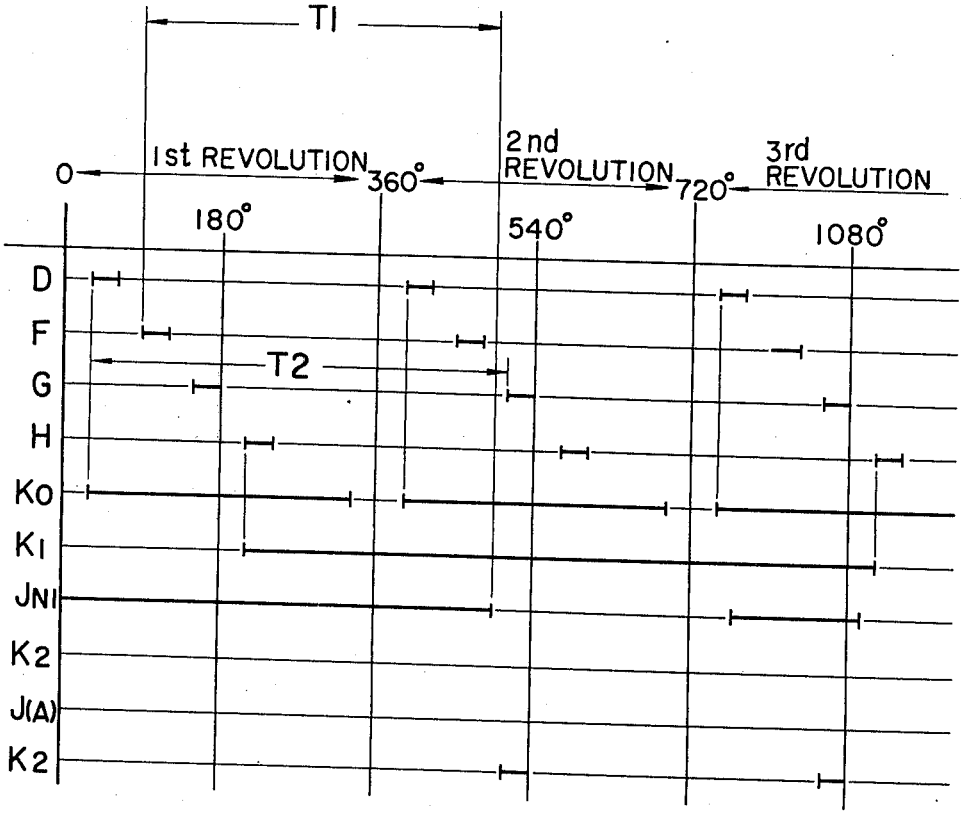
FIG. 3 is a flow chart for illustrating the operations of various parts of the device.

When an original to be copied, OR, is positioned, a microswitch E is closed to make the circuit of relay KO ready for operation. Under the circumstances, when a copy button is depressed, a switch C, mechanically associated with the depression of the copy button, is closed. During revolution of the photosensitive drum B after the closing of the switch C, a switch D′ is closed by a cam D mounted on the drum B to actuate a relay KO also and self-hold it at a contact KO 1. As depicted in FIG. 3, the sequential closing of the switches D′, F′, G′ and H′ is controlled by the cams D, F, G and H; Actuation of relay KO closes contacts KO2, KO3, KO4 and KO5. The closing of contact KO2 of the relay KO also actuates a clutch CL1 and transmits the rotation of the motor M to an original feeding roller R, while, the original OR moves in synchronism with the rotation of the photosensitive drum B and the original image travels through an optical system including light source L, mirror Q and lens T to form a light image on the surface of the photosensitive drum. When a switch F′ is closed by a cam F along with the rotation of the photosensitive drum B, electric current flows through the circuit of a clutch CL2 in cooperation with closed contact KO3, so that the clutch CL2 is actuated to lower the paper feed roller V until it comes to contact with the paper P, so the paper P is fed. Subsequently, a jam detecting switch G′ is closed by a cam G. However, since the relay K1, which controls contacts K11 and K12, is not yet actuated, even if a microswitch J disposed in the vicinity of the outlet for the paper P is in a closed state, an alarm device driving relay K2 is not actuated. When switch H′ is closed by cam H, switch H′ together with closed contacts KO4 and KO5 of the relay KO energize relay K1, which self-holds by means of contact K11.

If an original is continuously copied, when the photosensitive drum B has entered into its second revolution, the relay KO and so on will be energized to repeat the abovedescribed operation. In this case, as shown in FIG. 3, the time interval T1 required for a first paper sheet P to be properly fed and delivered to an outlet Z is equal to or slightly shorter than the time interval T2 or the interval between the time the copy paper leaves the feed station to when the detecting switch G′ is operated for the second time, i.e. T1 $\leqq$ T2. Therefore, even if the contact K12 is closed, the relay K2 will not be energized if the paper P is properly moved to open the switch J.

On the other hand, when the paper P is not properly being moved, the contact K12, switch G′ and switch J are all closed at the same time to energize the relay K2, thus detecting the abnormal condition or jamming of the paper. In this way, during a continuous copying operation, the contact KO5 prevents the switch H′ from deenergizing relay K′, whereby the relay K1 continues to self-hold, thus ensuring jam detection to be repeated in the same process as described above.

Where no second copy is desired, i.e. where the number of copies desired is one, the switch C may be mechanically released from its closed condition a little earlier in the second revolution of the photosensitive drum B than in the first revolution thereof, namely, at the angular position of about 300° to about 320°, so that the relay KO is not energized. The switch G′ is then closed to permit occurrence of jam detection, whereafter the contact KO5 and switch H′ are both opened so that the relay K1 releases its own self-hold, thus entirely deenergizing the relay K2 circuit.

Alternatively, in the above-described arrangement, the jam detecting switch G′ may be eliminated and the paper discharge detecting switch J may be disposed at a slightly displaced location so as to serve also as the jam detecting switch and cooperate with the paper feed switch F′ to satisfy the aforesaid time relation that T1 ≦ T2. Such a modified arrangement ensures a jam detecting operation to occur after completion of a paper feed operation has been confirmed, and this leads to the provision of a jam detecting device which is free of malfunctioning.

In the illustrated embodiment, the switch mechanism is shown to be a microswitch, whereas a combination of a lamp and a photoconductive element or a semiconductor switch element may also be employed. In FIG. 1, the letter U designates a charger, W an infrared ray heater and X a developing device.

The present invention establishes a time relation T1 T2 between the time T1 required for copy paper fed from the supply station to reach the outlet and the time T2 required from the time the paper leaves the supply station till the second closing of the jam detecting switch, and enables a jam detection to take place when the time relation is T1 > T2. Thus, the present invention requires no timer circuit. This entirely eliminates the inconvenience which would arise from the use of a timer circuit, more specifically, the inconvenience that the timer circuit is in a predetermined operative condition with respect to the variation in source voltage while the motor varies its number of revolutions with the source voltage variation to thereby give rise to error in jam detection. In addition, there is no need to equalize the time required for one full revolution of the photosensitive drum and the time required for the fed paper to reach the outlet, and this provides great advantages in the designing of copying machines. While the present invention has been illustrated with respect to a drum type photosensitive medium, it is to be understood that the present invention is also applicable to a flat photosensitive medium. Furthermore, the concept of the present invention is applicable not only to the transfer type copiers but also to the copiers of the type such as electrofax system wherein copy images are formed directly on a photosensitive medium. Moreover, where the photosensitive drum as shown in FIG. 1 is used, plural groups of cams D, F, G and H rotatable with the drum may be provided and the drum surface may be divided into a plurality of areas corresponding to the cam groups, whereby a plurality of copies may be obtained for one revolution of the drum and jam detections achieved simultaneously therewith.

We claim:

1. A jam detecting device for use in a copying machine comprising:

means for transporting copying materials along a path extending from a copying material stacking position to a discharging port, wherein transport commences for an individual copying material during each copying cycle of the machine, a movable photosensitive member, jam detecting means for detecting the jamming of copying material within the machine, means for activating said jam detecting means in response to said photosensitive member being moved to a predetermined position, said jam detecting means including discharge detecting means disposed along the transport path in the vicinity of said discharging port for detecting the discharge of each said copying material during a copying cycle subsequent to the cycle when transport of each said copying material commences, and means coupled to and operated by said jam detecting means for indicating the presence of jammed copying material after said jam detecting means is activated and when said discharge detecting means does not detect the discharge of copying material during said subsequent cycle.

2. A jam detecting device according to claim 1, further comprising a plurality of switch means, and means for actuating said switch means in response to movement of said photosensitive member, to activate said jam detecting means and to control said memory circuit.

3. A jam detecting device as set forth in claim 1 wherein said jam detecting means includes a memory circuit for preventing operation of said indicating means during a first copying cycle of the machine.

4. A jam detecting device according to claim 3 wherein said memory circuit includes a contact which remains opened when said jam detecting means is activated for the first time and which is closed when said jam detecting means is activated during said subsequent cycles, and wherein said indicating means includes a jam detecting relay for providing an output signal when jamming of copying material is detected and wherein said activating means, discharge detecting means, contact and jam detecting relay are connected in series.

* * * * *

UNITED STATES PATENT OFFICE

CERTIFICATE OF CORRECTION

Patent No. 3,948,586 Dated April 6, 1976

Inventor(s) SHIGEHIRO KOMORI, HISASHI SAKAMAKI, HIROYUKI HATTORI, TOSHIHIDE IIDA, KOICHI MIYAMOTO AND KAZUMI UMEZAWA It is certified that error appears in the above-identified patent and that said Letters Patent are hereby corrected as shown below:

Column 2, line 17, delete "also";

line 20, after "KO" insert --also--;

line 22, delete "also";

line 62, delete "K'" and insert --Kl--.

Column 3, line 26, before "T2" insert -- ≤ --.

Signed and Sealed this

Tenth Day of August 1976

[SEAL]

*Attest:*

RUTH C. MASON
*Attesting Officer*

C. MARSHALL DANN
*Commissioner of Patents and Trademarks*